US007627281B2

(12) United States Patent
Tanaka et al.

(10) Patent No.: US 7,627,281 B2
(45) Date of Patent: Dec. 1, 2009

(54) PAPER TRAY, PAPER FEEDER WITH THE TRAY, AND IMAGE FORMING DEVICE

(75) Inventors: Kenji Tanaka, Uji (JP); Yoshiyuki Nishizato, Nara (JP); Kenji Nakanishi, Sakurai (JP); Tomohiko Okada, Kyoto (JP); Akira Kohno, Nara (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 248 days.

(21) Appl. No.: 10/548,204

(22) PCT Filed: Apr. 1, 2004

(86) PCT No.: PCT/JP2004/004810

§ 371 (c)(1),
(2), (4) Date: Sep. 7, 2005

(87) PCT Pub. No.: WO2004/089794

PCT Pub. Date: Oct. 21, 2004

(65) Prior Publication Data

US 2006/0216088 A1 Sep. 28, 2006

(30) Foreign Application Priority Data

Apr. 3, 2003 (JP) ..... 2003-100710

(51) Int. Cl.
*G03G 15/00* (2006.01)

(52) U.S. Cl. ..... 399/377; 271/3.17; 271/227; 271/258.01; 271/259; 271/265.02; 399/389; 399/392; 399/405; 400/708

(58) Field of Classification Search ..... 399/377, 399/392, 405, 389; 400/708; 271/3.17, 227, 271/258.01, 259, 265.02
See application file for complete search history.

(56) References Cited

U.S. PATENT DOCUMENTS

| | | | | |
|---|---|---|---|---|
| 5,007,003 | A * | 4/1991 | Suzuki et al. | 358/1.13 |
| 5,342,036 | A * | 8/1994 | Golicz | 271/3.17 |
| 5,446,259 | A * | 8/1995 | Engstrom | 219/121.69 |
| 5,532,809 | A | 7/1996 | Hamanaka et al. | |
| 5,551,686 | A | 9/1996 | Sanchez et al. | |
| 6,496,670 | B1 * | 12/2002 | Ishikita et al. | 399/107 |

FOREIGN PATENT DOCUMENTS

| | | | |
|---|---|---|---|
| JP | 6-255839 | A | 9/1994 |
| JP | 8-259093 | A | 10/1996 |
| JP | 8-290835 | A | 11/1996 |
| JP | 9-67044 | A | 3/1997 |
| JP | 2002-347986 | A | 12/2002 |

* cited by examiner

*Primary Examiner*—Judy Nguyen
*Assistant Examiner*—Andy L Pham
(74) *Attorney, Agent, or Firm*—Birch, Stewart, Kolasch & Birch, LLP

(57) ABSTRACT

A sheet tray (1) includes at least one sheet detecting sensor (10) for detecting a sheet set on a sheet setting surface (2). The sheet detecting sensor (10) includes (i) a movable detecting section having a projecting section which projects from the sheet setting surface (2), and (ii) a detecting section for detecting rotation of the movable detecting section, and the projecting section have a ball-like shape. This makes it possible to provide (i) a sheet tray which is able to prevent breakage of sheet and breakage of the projecting section even when setting the sheet on the sheet setting surface from any direction and any angle; (ii) a sheet transporting apparatus including the sheet tray; and (iii) an image forming apparatus including the sheet tray.

20 Claims, 10 Drawing Sheets

PAPER TRAY, PAPER FEEDER WITH THE TRAY, AND IMAGE FORMING DEVICE

BACKGROUND OF THE INVENTION FIELD OF THE INVENTION

The present invention relates to (i) a sheet tray which is provided in a document transporting apparatus, a sheet feeding apparatus, and the like, and on which sheets such as documents (originals) are set; (ii) a sheet transporting apparatus for transporting the sheet from the sheet tray; and (iii) an image forming apparatus including the sheet tray.

DESCRIPTION OF THE RELATED ART

Generally, an image forming apparatus such as a copying machine, and a document scanning apparatus such as a scanner each include a document transporting apparatus for automatically transporting each of documents (originals) to a document scanning section. Such a document transporting apparatus includes a document tray on which the document (sheet) is set, and which detects (i) a document size and/or (ii) whether or not the document is set thereon. Specifically, the document tray includes a document detecting sensor, which detects (i) the document size and/or (ii) whether or not the document is set.

Specifically, when each of the image forming apparatus and the document scanning apparatus makes a copy of the document or scans the document, the document detecting sensor of the document transporting apparatus detects (i) the document size and/or (ii) whether or not the document are set, and then the document set on the document tray is transported. The image on the document thus transported is scanned by the image scanning section.

Exemplified here as one example of the document detection sensor is a contact type document detecting sensor. The following explains a conventional example of such a contact type document detecting sensor, with reference to FIG. 10(*a*) and FIG. 10(*b*). FIG. 10(*a*) is a diagram illustrating the document tray, provided on a conventional digital copying machine, when viewed from above. FIG. 10(*b*) is an oblique view illustrating the document tray. As shown in FIG. 10(*a*) and FIG. 10(*b*), the document tray 50 includes two contact type document detecting sensors 51. Each of the contact type document detecting sensors 51 is so provided as to project from a document setting surface 52 of the document tray 50. The projecting section of the document detecting sensor 51 has a substantially triangle (thin triangular prism) shape. The document detecting sensor 51 is provided in such a manner that: a flat surface of the substantially triangle shape is substantially perpendicular to the document setting surface 52, and the flat surface of the substantially triangle shape of the projecting section is parallel to a document transporting direction, i.e., a direction in which the document is transported.

Further, the document detecting sensor 51 is provided such that the projecting section projecting from the document setting surface 52 is rotatable with respect to a rotation axis (not shown). When setting the document on the document setting surface 52, the projecting section of the document setting sensor 51 is pressed down in the direction of the document setting surface 52. In response to the press-down, the document detecting sensor 51 detects the document.

One example of such a contact type document detecting sensor is disclosed in Japanese Unexamined Patent Publication Tokukaihei 08-290835/1996 (published on Nov. 5, 1996). Specifically, disclosed in the patent publication is such a structure that a rear end detecting sensor, which is so provided on a document tray as to be substantially parallel to the document transporting direction, detects the rear end of the document so as to recognize a document size. Moreover, the patent publication describes that: the surface of the document tray is uneven such that the document is bent, in an axisymmetric manner, at its longitudinal center portion. This surely allows detection of each rear end position of the several documents.

Further, some image forming apparatus such as a copying machine or a printer includes a manual sheet feeding tray (manual sheet feeding section) such that a sheet can be fed from outside of the image forming apparatus. Such a manual sheet feeding tray also includes a sheet detecting sensor. The sheet detecting sensor is also a contact type detecting sensor having a projecting section whose structure is the same as that of the aforementioned document detecting sensor. Specifically, the projecting section of the detecting sensor has a substantially triangle shape whose flat surface is substantially perpendicular to the sheet setting surface of the manual sheet feeding tray and is substantially parallel to the sheet feeding direction. In the manual sheet feeding tray, the detecting sensor detects (i) the sheet size and/or (ii) presence or absence of the sheet, and the sheet is fed from the manual sheet feeding tray when carrying out copying and printing.

In some cases, a user sets the sheet from the direction of the side surface of the projecting section of the detecting sensor, i.e., from the direction of the flat surface of the substantially triangle shape. In this case, the sheet collides with the projecting section. Such collision with the triangle-shaped projecting section of the detecting sensor is likely to cause (i) breakage of the projecting section (breakage of the detecting sensor), and (ii) breakage of the sheet (crease and tear-off of the sheet). Further, in cases where a part of user's body (e.g., hand) collides with the projecting section, the user is possibly injured.

The present invention is made in light of the problem, and its object is to provide (i) a sheet tray, which is able to prevent the breakage of the sheet and the breakage of the detecting sensor even when setting the sheet from any direction and any angle; (ii) a sheet transporting apparatus including the sheet tray; and (iii) an image forming apparatus including the sheet tray.

SUMMARY OF THE INVENTION

To solve the problem, a sheet tray of the present invention includes: at least one sheet detecting means for detecting a sheet set on a sheet setting surface, wherein: the sheet detecting means includes (i) a movable detecting section having a projecting section which projects from the sheet setting surface, and (ii) a detecting section for detecting rotation of the movable detecting section; and the projecting section have a ball-like shape.

According to the structure above, the projecting section which projects from the sheet setting surface has the ball-like shape. Therefore, the sheet can be prevented from being scratched by collision with the projecting section, even when setting the sheet from any direction and any angle. This allows prevention of (i) the breakage of the sheet, and (ii) the breakage of the projecting section. Moreover, with this, a part of the user's body is never scratched by the projecting section, so that the user can be prevented from being injured. Note that the wording "ball-like shape" in the present invention encompasses a case where a portion, which projects from the sheet setting surface, of the projecting section is a part of the ball.

Further, the wording "sheet" in the present invention encompasses, e.g., a document (original) including an image, writing, and/or the like.

In addition to the structure, it is preferable to arrange the sheet tray of the present invention such that the detecting section is so provided as to detect an end of the movable detecting section.

According to the structure above, the detection section is so provided as to detect one end of the movable detecting section. This allows more precise detection of the rotation of the movable detecting section, even when the movement of the movable detecting section is slight. In other words, this allows improvement of precision in detecting the sheet.

It is preferable to arrange the sheet tray of the present invention such that: the projecting section includes a ball, which is rotatably held by a holder; and the ball is exposed from an aperture portion of the holder, and projects from the sheet setting surface.

According to the structure above, the ball is rotatable, so that the sheet can be further prevented from being scratched by the projecting section that is the ball. This allows further prevention of (i) the breakage of the sheet and (ii) the breakage of the projecting section. This also allows prevention of crease on the sheet. Further, a part of the user's body is never scratched by the projecting section that is the ball, so that the user can be prevented from being injured. Further, it is preferable to arrange the sheet tray such that the aperture portion of the holder has a diameter smaller than a diameter of the ball. This allows prevention of displacement of the ball from the holder.

Further, it is preferable to arrange the sheet tray such that: the projecting section of at least one of the sheet detecting means projects from the sheet setting surface, and is positioned away, from an end regulating member for regulating an end of each sheet set on the sheet setting surface, by either (i) a distance corresponding to a smallest width of a standard sheet, or (ii) a distance shorter than the distance. This makes it possible to detect a sheet having the smallest standard size.

A sheet transporting apparatus of the present invention includes the sheet tray.

According to the structure above, the projecting section which projects from the sheet setting surface has the ball-like shape. Therefore, the sheet can be prevented from being scratched by collision with the projecting section, even when setting the sheet from any direction and any angle. This makes it possible to provide a sheet transporting apparatus that allows prevention of (i) the breakage of the sheet, and (ii) the breakage of the projecting section. Moreover, with this, a part of the user's body is never scratched by the projecting section, so that the user can be prevented from being injured.

An image forming apparatus of the present invention includes the sheet tray.

According to the structure above, the projecting section which projects from the sheet setting surface has the ball-like shape. Therefore, the sheet can be prevented from being scratched by collision with the projecting section, even when setting the sheet from any direction and any angle. This makes it possible to provide an image forming apparatus that allows prevention of (i) the breakage of the sheet, and (ii) the breakage of the projecting section. Moreover, with this, a part of the user's body is never scratched by the projecting section, so that the user can be prevented from being injured.

Additional objects, features, and strengths of the present invention will be made clear by the description below. Further, the advantages of the present invention will be evident from the following explanation in reference to the drawings.

Figure 3A:
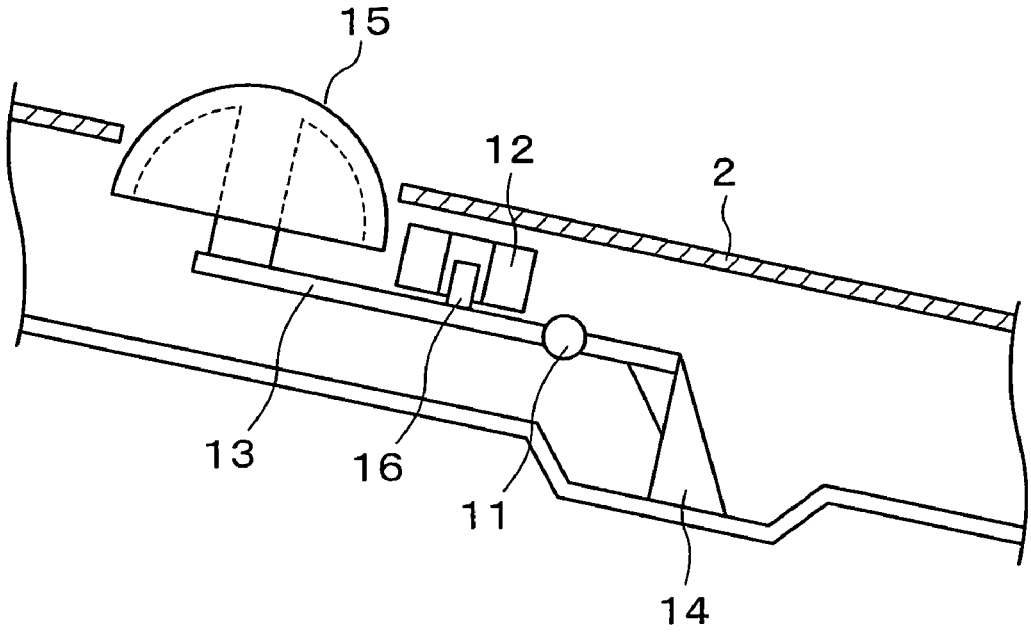
Figure 3B:
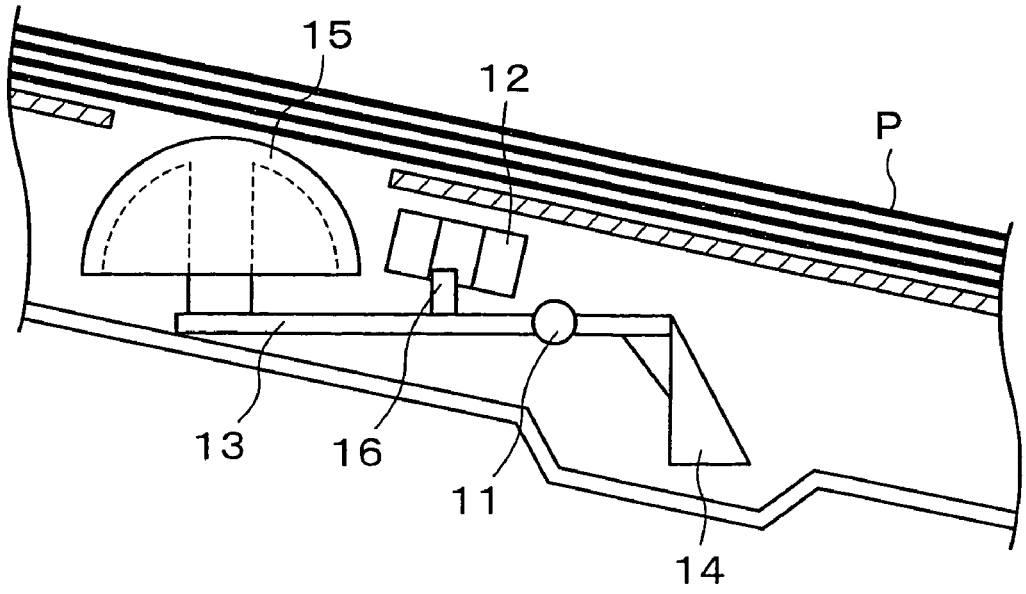

Each of FIG. 3(*a*) and FIG. 3(*b*) is a cross sectional view illustrating how the sheet detecting sensor detects sheets.

Figure 4:
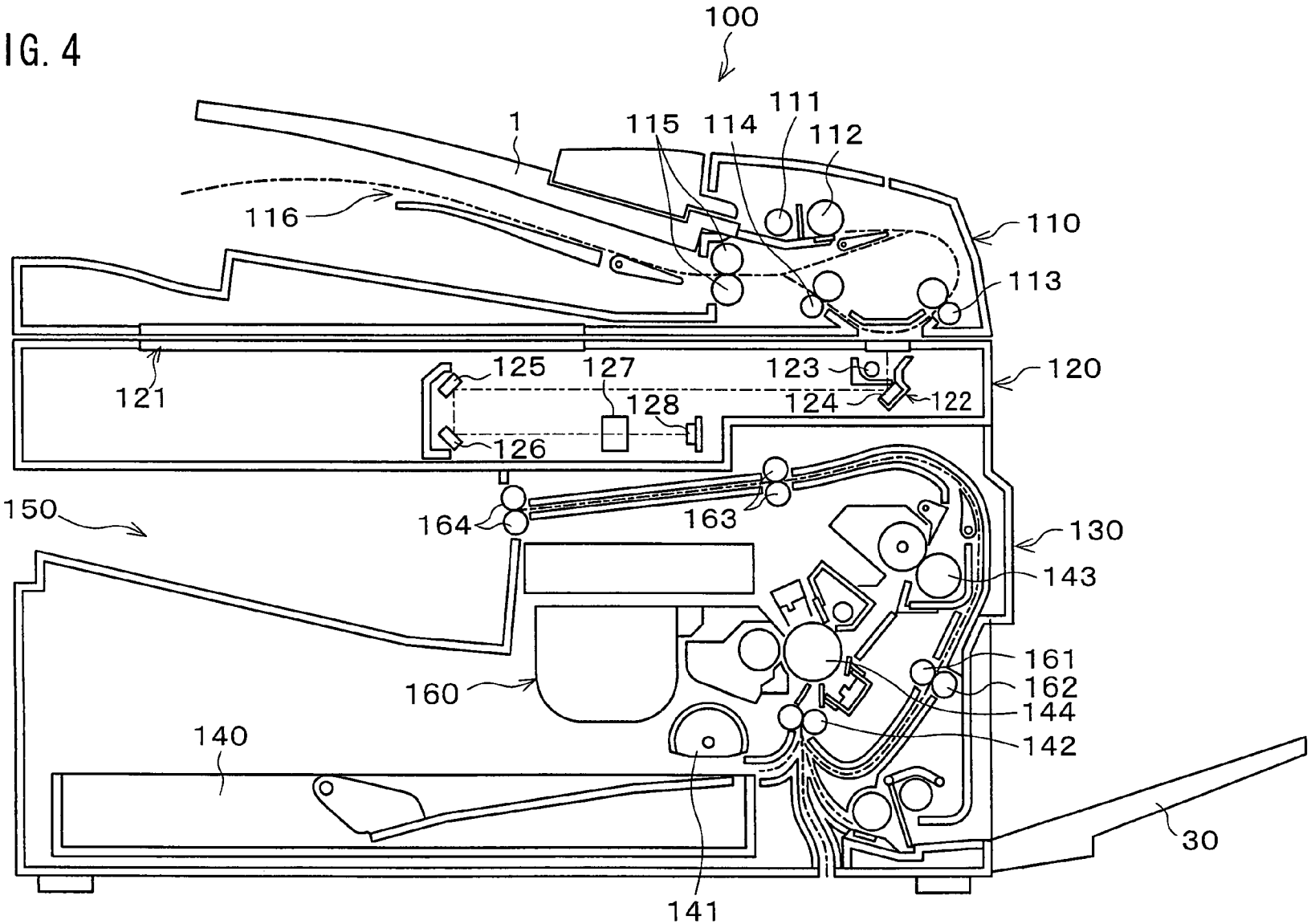

FIG. 4 is a cross sectional view illustrating a structure of a major part of the image forming apparatus including a sheet transporting apparatus including the sheet tray.

Figure 5A:
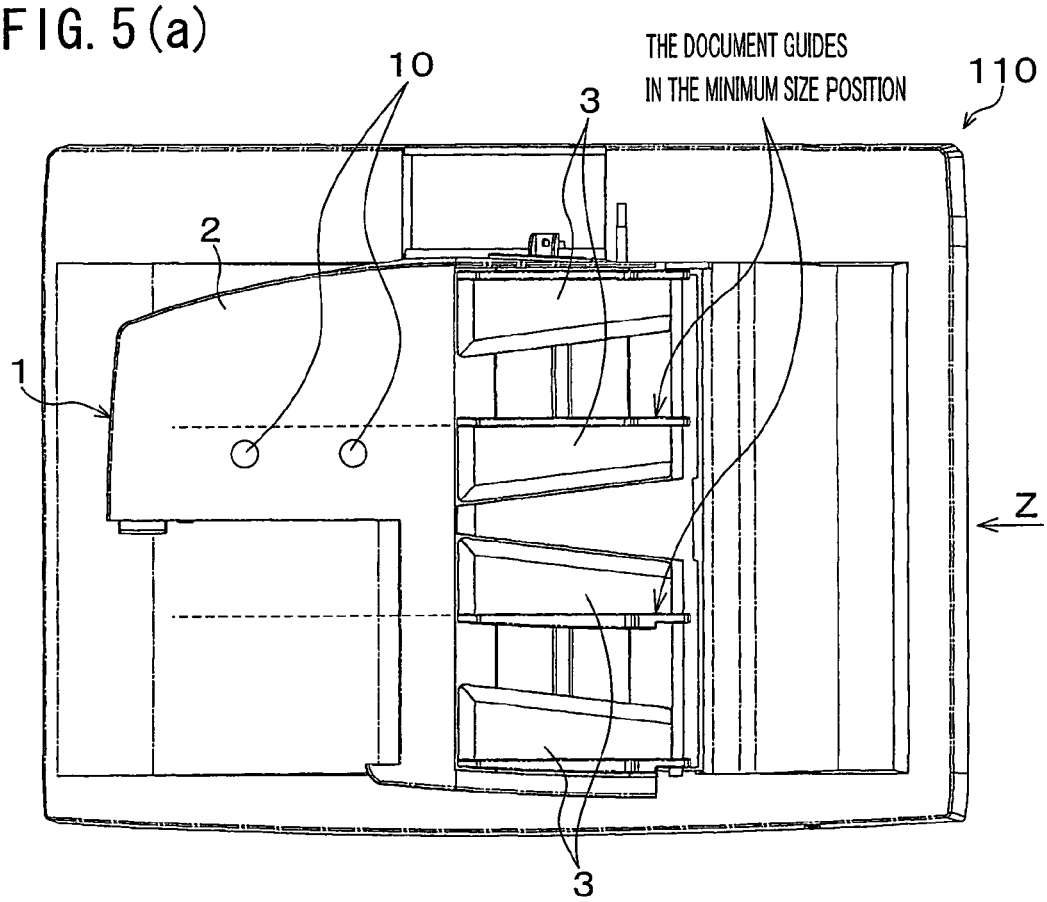
Figure 5B:
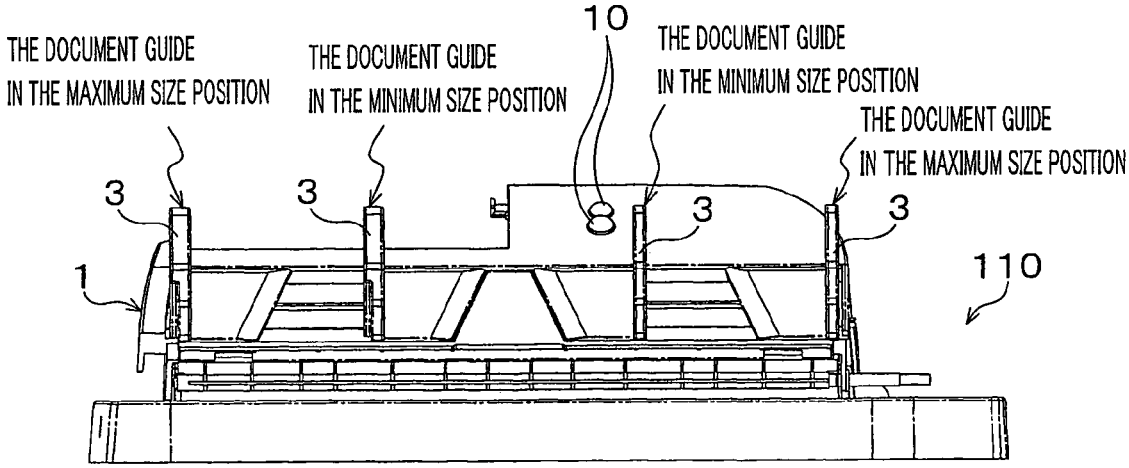

FIG. 5(*a*) is a diagram illustrating the sheet transporting apparatus when viewed from above. FIG. 5(*b*) is a side view illustrating the sheet transporting apparatus when viewed in a direction of an arrow Z shown in FIG. 5(*a*).

Figure 6:
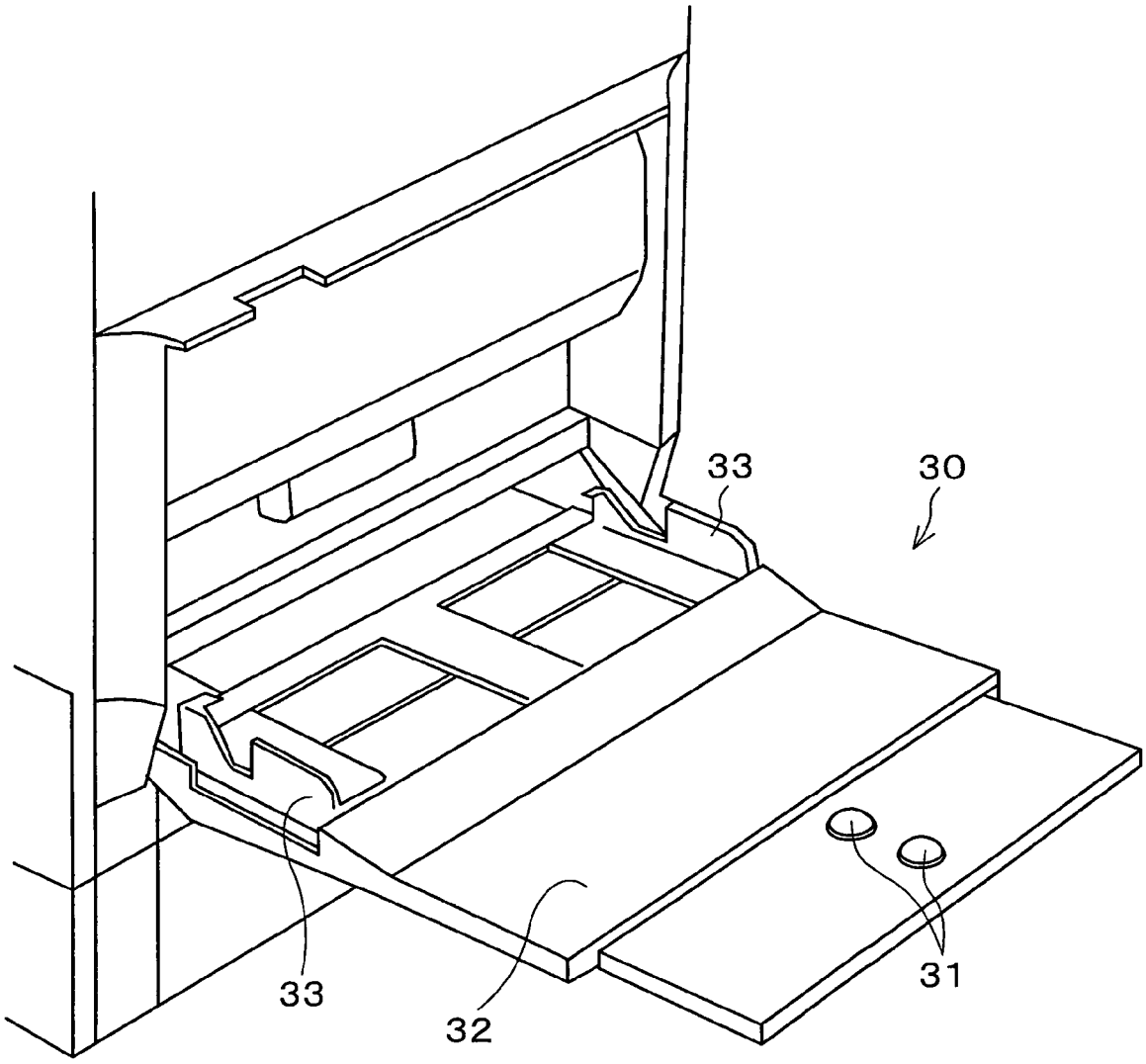

FIG. 6 is an oblique view illustrating a manual sheet feeding tray, which is provided in the image forming apparatus and which has a sheet detecting sensor.

Figure 7:
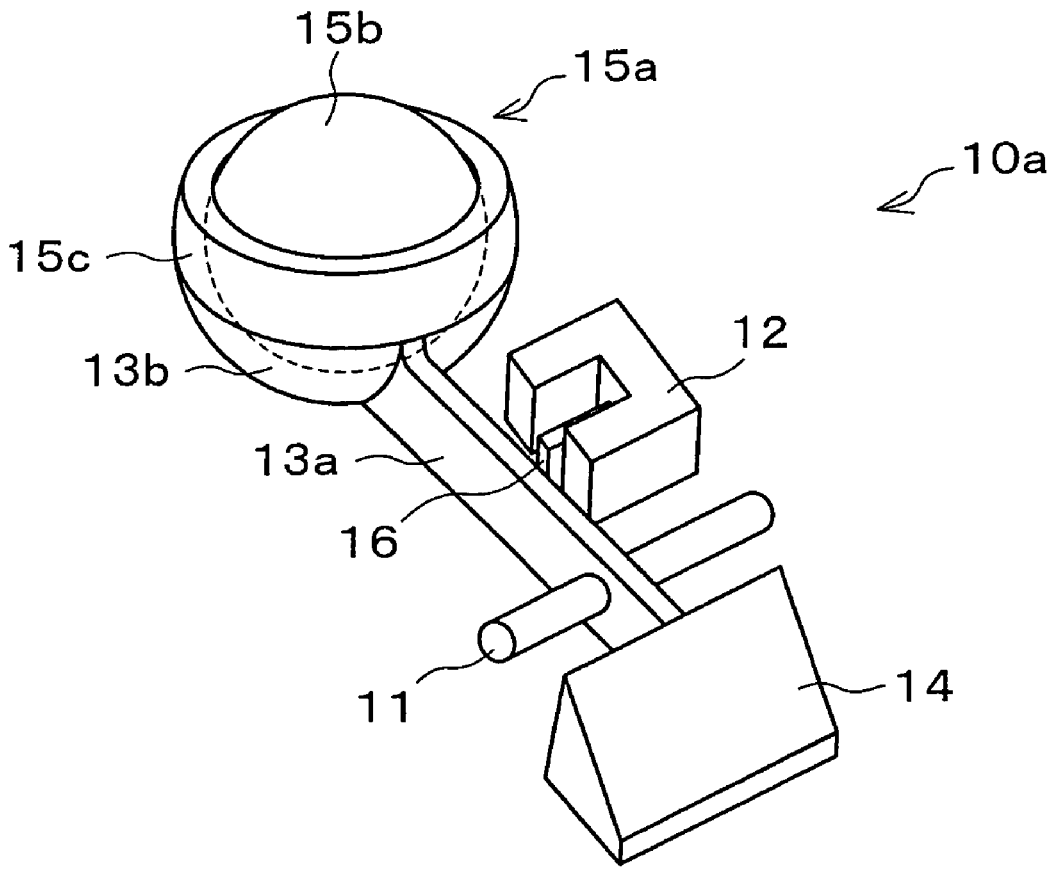

FIG. 7 is an oblique view illustrating another structure example of the sheet detecting sensor.

Figure 8:
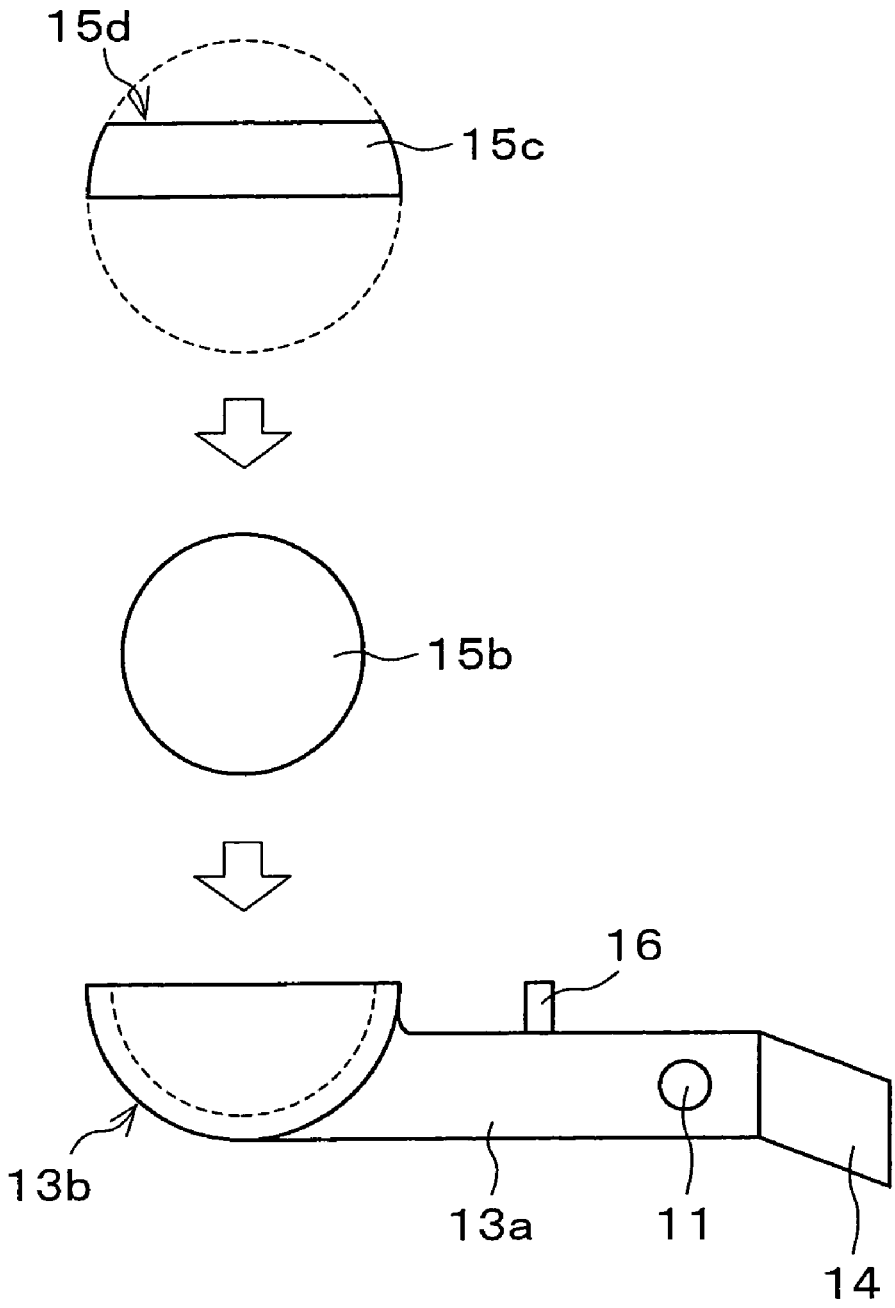

FIG. 8 is a cross sectional view illustrating a disassembled structure of the sheet detecting sensor shown in FIG. 7.

Figure 9A:
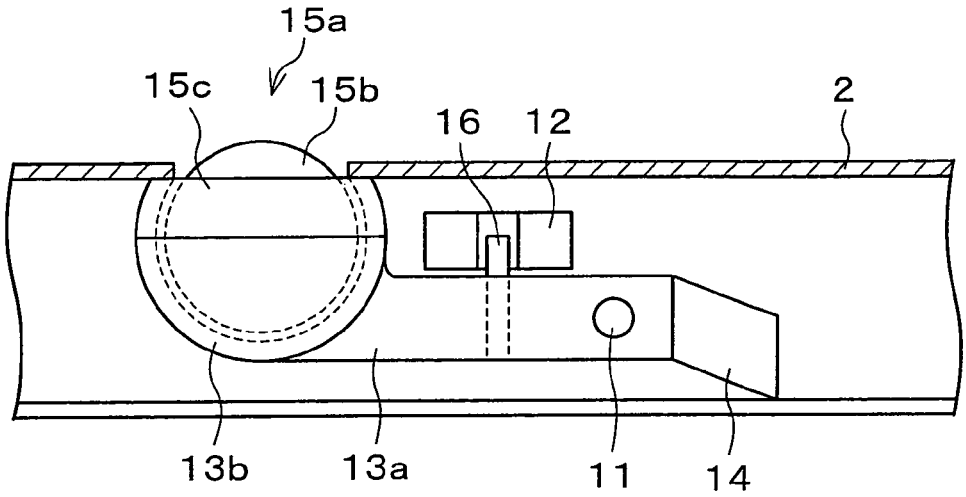
Figure 9B:
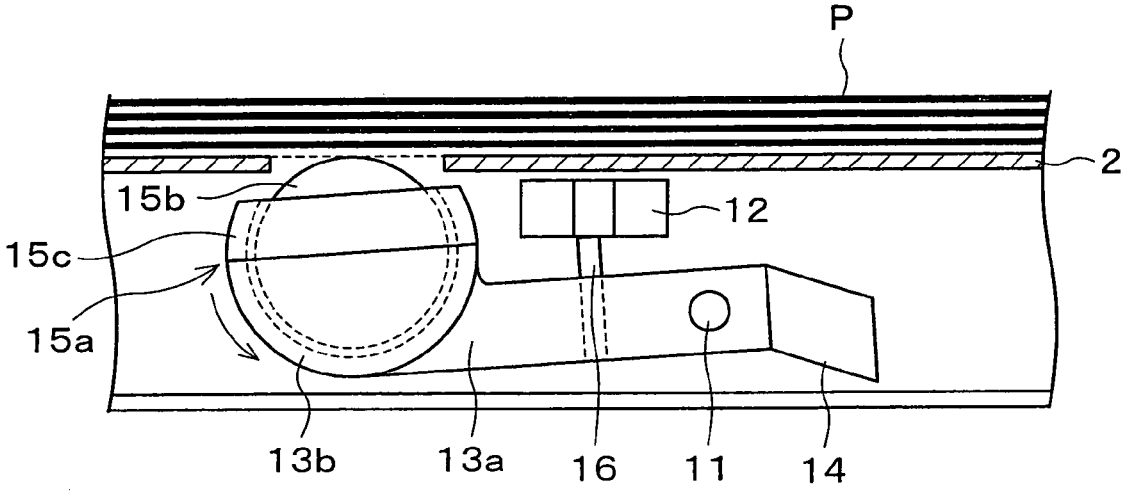

Each of FIG. 9(*a*) and FIG. 9(*b*) is an explanatory cross sectional view illustrating how the sheet detecting sensor shown in FIG. 7 detects sheets.

Figure 10A:
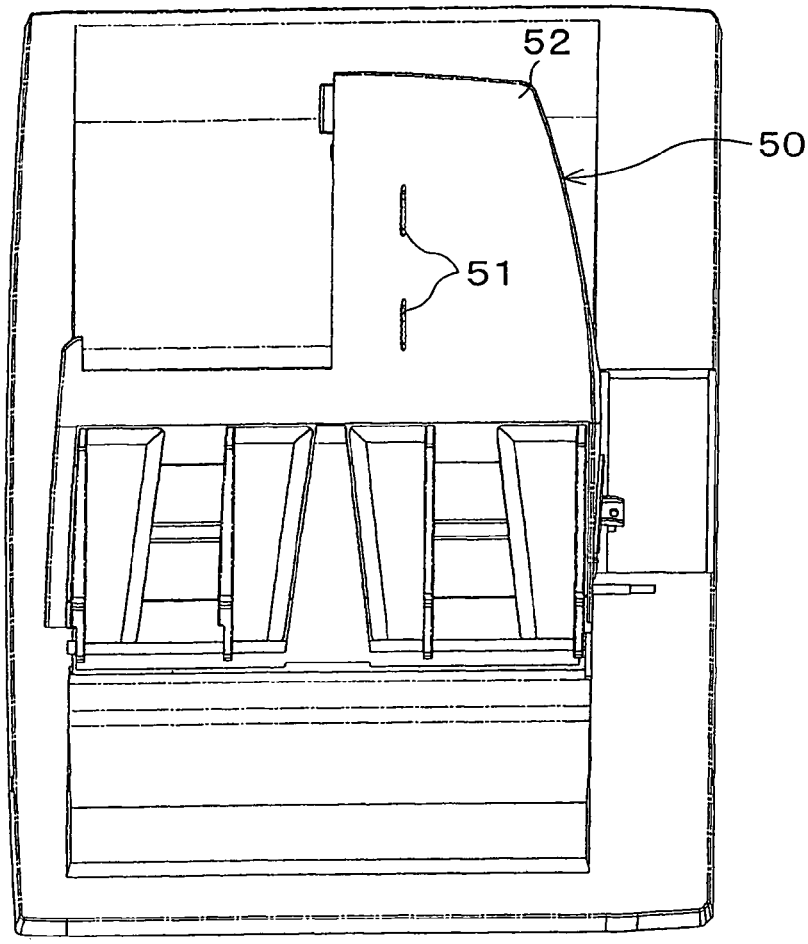
FIG. 10(a) PRIOR ART
Figure 10B:
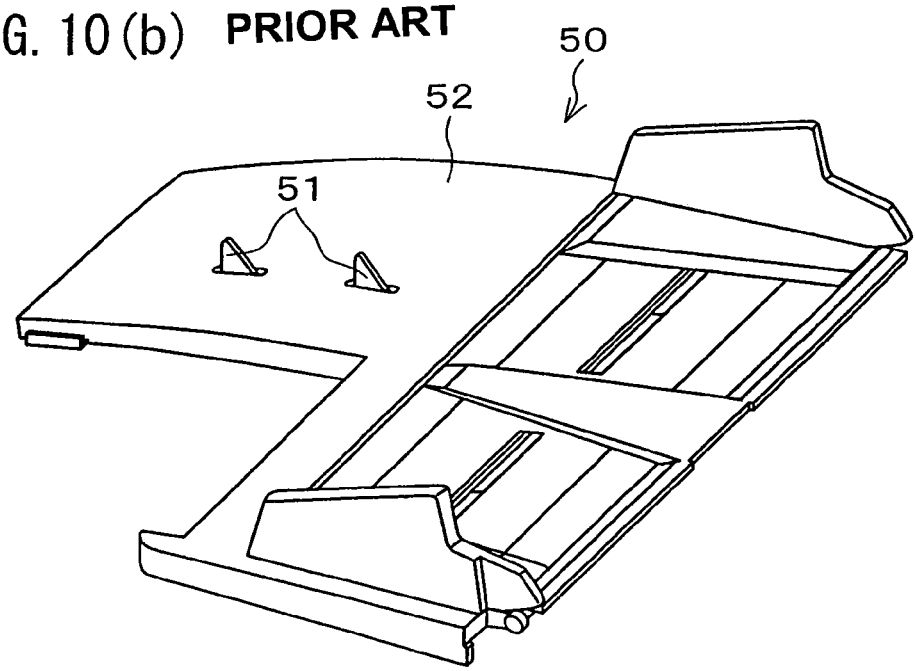
FIG. 10(b) PRIOR ART

FIG. 10(*a*) is a diagram illustrating a conventional document tray when viewed from above. FIG. 10(*b*) is an oblique view illustrating the document tray.

DETAILED DESCRIPTION OF THE INVENTION

The following explains the present invention in further detail with reference to Embodiments; however, the present invention is not limited to these.

EMBODIMENT 1

The following explains one embodiment of a sheet tray, which is according to the present invention and which is provided in a sheet transporting apparatus or the like, with reference to FIG. 1 through FIG. 6.

Figure 1:
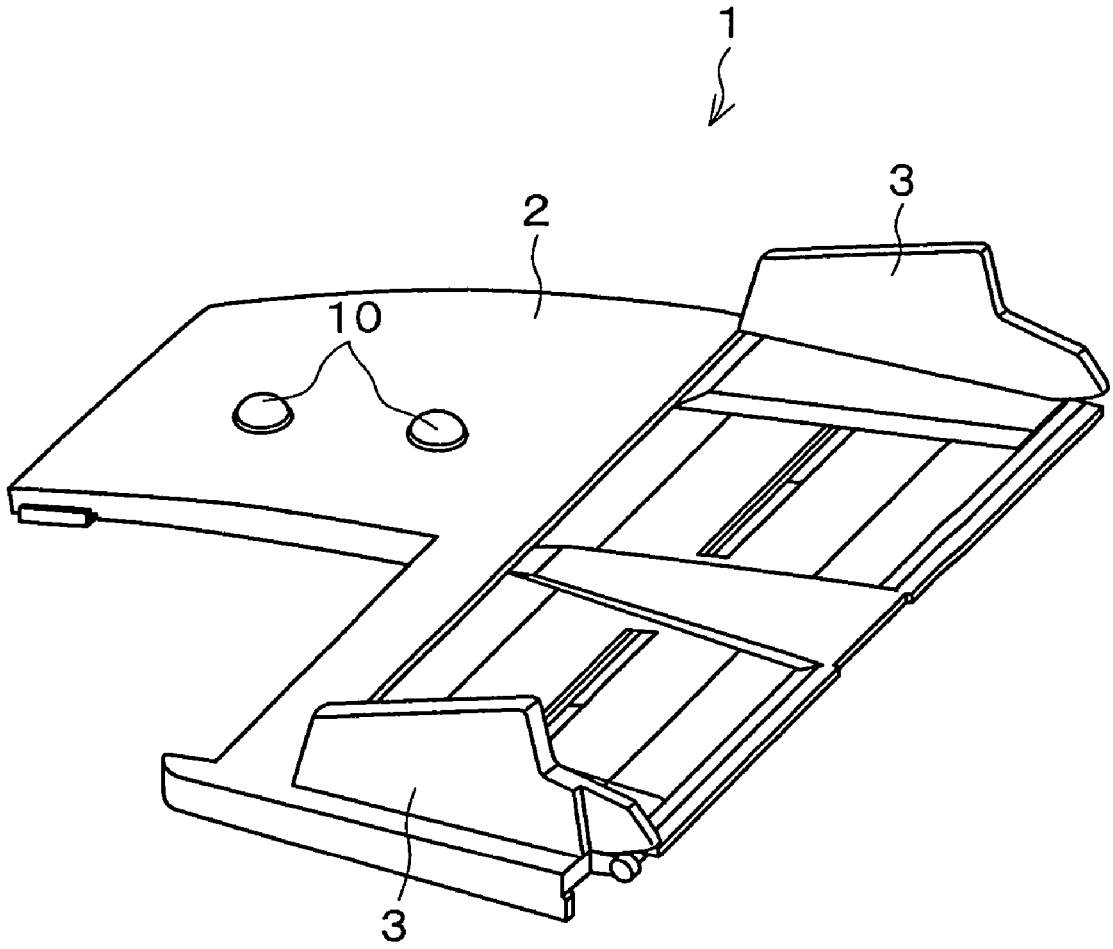
FIG. 1 is an oblique view illustrating a sheet tray according to one embodiment of the present invention.

FIG. 1 is an oblique view illustrating the sheet tray according to the present embodiment. As shown in FIG. 1, the sheet tray 1 includes (i) sheet detecting sensors (sheet detecting means) 10, (ii) sheet guides 3, and (iii) a sheet setting surface 2. Each of the sheet sensors 10 of the sheet tray 1 detects whether or not a sheet such as a document (original) is set on the sheet setting surface 2. Note that the number of the sheet detecting sensors 10 provided in the sheet trays 1 is not particularly limited.

Figure 2:
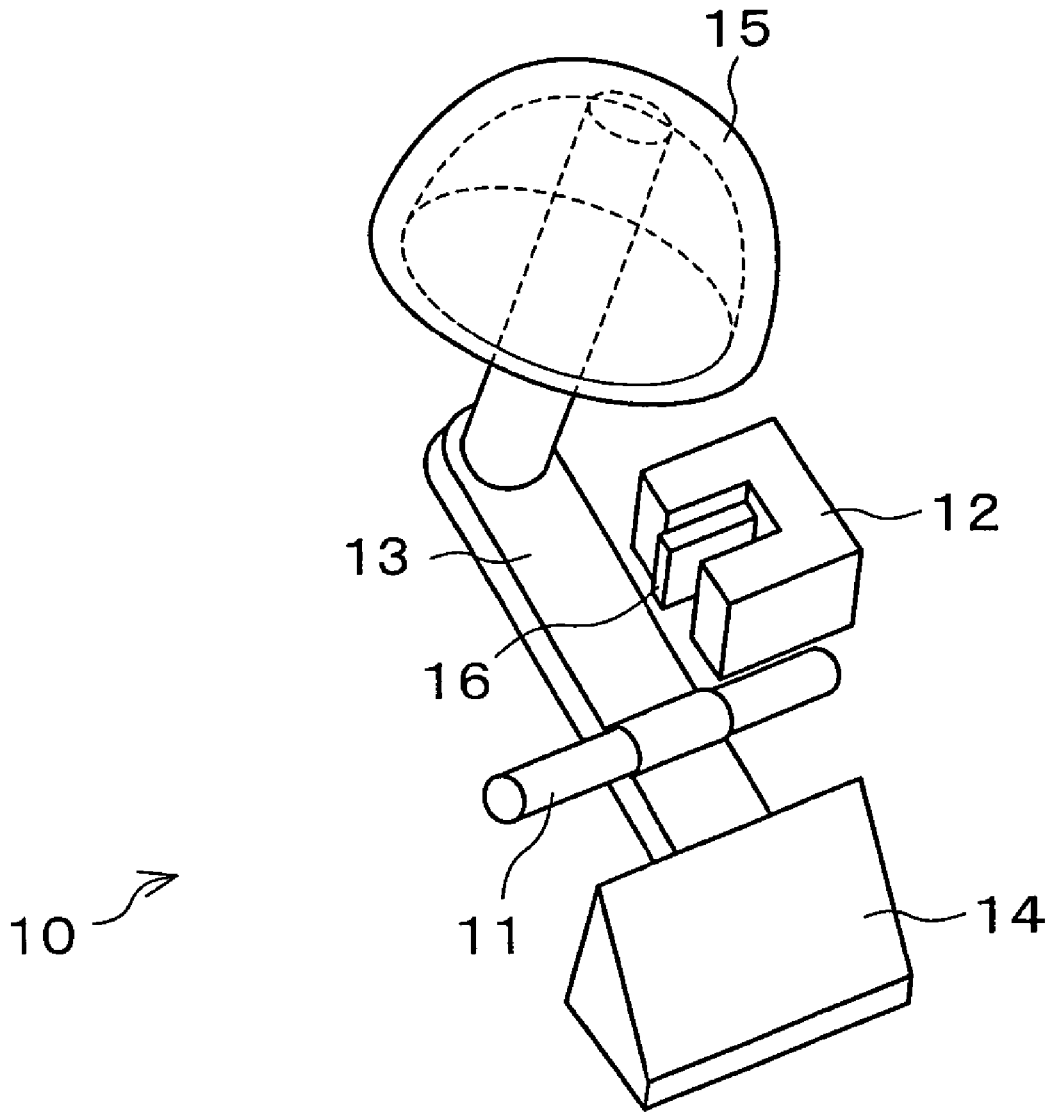
FIG. 2 is an oblique view illustrating one structure example of a sheet detecting sensor used in the sheet tray.

Explained here is further detail of the sheet detecting sensor with reference to FIG. 2, FIG. 3(*a*), and FIG. 3(*b*). FIG. 2 is an oblique view illustrating each of the sheet detecting sensors 10 according to the present embodiment. Each of FIG. 3(*a*) and FIG. 3(*b*) is a cross sectional view illustrating movement of the sheet detecting sensor 10 upon detecting the sheet.

See FIG. 2. The sheet detecting sensor 10 according to the present embodiment includes: (i) a movable detecting section having a supporting bar 13 which is rotatably provided on a rotation fulcrum (movable fulcrum) 11; and (ii) a photo sensor (detecting section) 12. The supporting bar 13 has a longitudinal side perpendicular to the axis direction of the rotation fulcrum 11. The supporting bar 13 has one end in which a projecting section 15 is provided. Provided on the other end of the supporting bar 13 is a weight 14. Further, the supporting bar 13 is provided with a light shielding rib 16 for shielding incoming light to the photo sensor 12. Namely, the rotation fulcrum 11, the supporting bar 13, the projecting section 15, and the weight 14 constitute the movable detecting section. Further, the supporting bar 13, the projecting section 15, and the weight 14 constitute a main body of the movable detecting section (hereinafter, referred to as "movable detecting section main body"). When the projecting section 15 is not pressed by the sheet or the like, the weight 14 causes the movable detecting section main body to rotate with respect to the rotation fulcrum 11. In other words, when the projecting section 15 is not pressed by the sheet or the like, the projecting section 15 always projects from the sheet setting surface 2 via an aperture portion formed in the sheet setting surface 2.

The following explains how the sheet detecting sensor 10 detects the sheet, with reference to FIG. 3(*a*) and FIG. 3(*b*).

Firstly, see FIG. 3(*a*). Normally, the sheet detecting sensor 10 is on standby. While the sheet detecting sensor 10 is on standby, the sheet detecting sensor 10 detects that there is no sheet set on the sheet setting surface 2, and the projecting section 15 projects from the aperture portion (setting surface aperture portion) of the sheet setting surface 2. Further, the light shielding rib 16 shields the incoming light to the photo sensor 12, so that the photo sensor 12 does not detect the light. The sheet detecting sensor 10 regards such a condition under which the photo sensor 12 detects no light, as a condition (absence of sheets) under which no sheet is set on the sheet setting surface 2.

Next, see FIG. 3(*b*) illustrating a case (sheet set state) where sheets P are set on the sheet setting surface 2. In this case, the sheets P press down the projecting section 15 of the sheet detecting sensor 10 in the direction of the sheet setting surface 2. Accordingly, the light shielding rib 16 does not shield the incoming light to the photo sensor 12, with the result that the photo sensor 12 detects the light. The sheet detecting sensor 10 regards such a condition under which the photo sensor 12 detects the light, as a condition (presence of sheets) under which the sheets P are set on the sheet setting surface 2.

Here, the projecting section 15 has a portion projecting from the sheet setting surface 2, and the portion has a ball-like (round) shape. Because the projecting section 15 has such a portion having a ball-like shape, the sheets P can be prevented from being scratched by the collision with the projecting section 15, even when setting the sheets P on the sheet setting surface 2 from any direction and any angle. This allows prevention of (i) the breakage of the sheets P and (ii) the breakage of the projecting section 15. Also, such a projecting section 15 allows prevention of crease on the sheets P. Moreover, such a projecting section 15 never scratches a part of the user's body, so that the user can be prevented from being injured. The sheets P are never scratched by the projecting section 15 as such, and are so set on the sheet setting surface 2 as to press down the projecting section 15, so that the sheet detecting sensor 10 can precisely detect whether or not there are sheets on the sheet setting surface 2.

Further, it is preferable that the light shielding rib 16 be provided on an end (a furthest portion) of the supporting bar 13. Further, it is preferable that the photo sensor 12 be so provided as to correspond to the location in which the light shielding rib 16 is provided. In other words, it is preferable that the photo sensor 12 be so provided as to detect the movement of the end of the supporting bar 13. This makes it possible that the sheet detecting sensor 10 easily detects presence or absence of the sheets in response to even slight movement (rotation) of pressing down the projecting section 15 in the direction of the sheet setting surface 2. In other words, even when, e.g., a small number of sheets are set on the sheet setting surface 2, the sheet detecting sensor 10 can detect with ease whether or not the sheets are set thereon.

See FIG. 1. The sheet guides 3 are a pair of sheet guides provided face to face. The sheet guides 3 guide sides of each of the sheets set on the sheet setting surface 2, and are used according to the width of the sheet set on the sheet setting surface 2. Specifically, the sheet guides 3 are arranged, e.g., as follows. That is, moving one of the guide plates causes the other guide plate to move in a symmetrical manner with respect to the center between the counter surfaces of the guide plates. With this, irrespective of a sheet size difference, i.e., irrespective of a sheet width difference, the sheets are always set on the sheet setting surface 2 such that the center line of the sheet setting surface 2 coincides with the center line of the width of the sheet. In other words, the sheets are always set on a predetermined position of the sheet setting surface 2.

Next, the following explains (i) a sheet transporting apparatus including the sheet tray 1, and (ii) an image forming apparatus including the sheet transporting apparatus, with reference to FIG. 4. A specific example of the image forming apparatus is a digital copying machine.

FIG. 4 is a cross sectional view illustrating a structure of a major part of the image forming apparatus including the sheet transporting apparatus. Such an image forming apparatus 100 has the following print modes: a copy mode, a printer mode, and a FAX mode. A control section of the image forming apparatus 100 selects a process mode in accordance with a printing request in each of the print modes. The image forming apparatus 100 includes: (i) a document transporting section (sheet transporting apparatus) 110, (ii) a document scanning section (document scanning means (scanner section)) 120, and (iii) an image forming section 130.

The image forming section 130 is made up of: a sheet feeding section (sheet feeding means) 140, a printing section (printing means) 160, and a sheet eject section 150. Further, the document scanning section 120 is provided above the sheet feeding section 140. The sheet eject section 150 is provided between the document scanning section 120 and the sheet feeding section 140.

The document transporting section 110 is a so-called "automatic document transporting apparatus", and includes the aforementioned sheet tray 1. The document transporting section 110 transports each of the documents set on the sheet tray 1, to the document scanning section 120 by using document transporting rollers 111 through 113. The document thus transported is scanned as image information by the document scanning section 120. The document thus scanned is ejected to a document eject section 116 by using document ejecting rollers 114 and 115.

See FIG. 5(*a*) and FIG. 5(*b*). The sheet guides 3 in the document transporting section 110 may move between, e.g., a minimum size position and a maximum size position so as to accommodate to a predetermined sheet size. Here, the wording "minimum size position" refers to such a position that corresponds to the width of a sheet, which can be set on the sheet setting surface 2 and which has the smallest size with which the sheet guides 3 can deal. Likewise, the wording "maximum size position" refers to such a position that corresponds to the width of a sheet, which can be set on the sheet setting surface 2 and which has the largest size with which the sheet guides 3 can deal. Further, it is preferable that the smallest size of the sheet and the largest size of the sheet be in compliant with the standard sizes such as the B5 size, the A4 size, and the A3 size.

Further, it is preferable that an end regulating member (not shown) regulate one of two sides of each sheet, which sides are different from the two sides positioned in the width direction of the sheet. In other words, it is preferable that the sheet tray 1 include the end regulating member for regulating the end of the sheet set on the sheet setting surface 2. Further, it is preferable that at least one sheet detecting sensor 10 be provided away, from an end regulating member for regulating an end of each sheet set on the sheet setting surface, by either (i) a distance corresponding to a smallest width (width in the short length direction of a smallest standard sheet) of a standard sheet, or (ii) a distance shorter than the distance. This makes it possible to surely detect presence or absence of the sheet, even when the sheet has the smallest standard size. Note that, it is preferable that the end regulating member be provided on the end of the sheet tray 1, which end is positioned in the direction in which the sheet is transported from the sheet tray 1.

The following explains the copy mode of the aforementioned process modes in the image forming apparatus 100.

When a document for printing is set on a platen glass (document setting table) 121 of the document scanning section (scanner section) 120, the user supplies sheets to a sheet feed cassette of the sheet feeding section 140, and then operates condition input keys (the quantity of copies to be printed, print scale, etc.) of an operation panel (not shown) provided on a front portion of an outer chassis of the image forming apparatus 100, and then presses a start key, with the result that the copy operation is started. Further, in cases where a document is set on the document transporting section 110, the document scanning described later is started in response to press of the start key, with the result that the copy operation is started.

The printing is started in this way in the image forming apparatus 100. In response to the press of the start key, the image forming apparatus 100 causes a main drive motor to start operating, with the result that drive gears rotate. This causes a sheet feeding roller 141 to rotate to feed the sheet. The sheet thus fed is sent to a resist roller 143 via a transporting roller 142.

The sending of the sheet is temporarily suspended in the resist roller 143, and the front end of the sheet is evenly pushed against the resist roller 143 such that the front end will be aligned with a front end of an image formed on a photosensitive drum 144. This allows correction of the front end position of the sheet.

Meanwhile, in the document scanning section 120, a copy lamp (light source) 123 emits light, and a copy lamp unit 122 having the copy lamp 123 moves under the platen glass 121. The document on the platen glass 121 is exposed to the light, and the scanning of the image information is started. The light emitted from the copy lamp 123 is so reflected as to have the image information of the document. The light thus reflected is reflected by a first mirror 124, a second mirror 125, and a third mirror 126 of the copy lamp unit 122, with the result that the light is incidented on an optical coupling device (CCD) 128 via an optical lens 127. The optical coupling device 128 receives the reflected light as the image information.

The image information thus scanned, i.e., the image information provided by the incidented light (reflected light) is converted into an electric image information signal by a CCD circuit of the control section (not shown) provided in the apparatus. The image information signal is subjected to image processing under a determined condition, and then is transmitted to a laser scanning unit (LSU) as print data.

Meanwhile, in the printing section 160, the entire photosensitive drum 144 is discharged at a predetermined discharge potential by a discharge unit (not shown). The laser beam from the LSU is incidented on the photosensitive drum 144 via a polygon mirror and various lenses, with the result that an electrostatic latent image is formed on the photosensitive drum 144. Thereafter, a toner on an MG roller in a developer tank is drawn to the surface of the photosensitive drum 144, with the result that the toner visualizes the electric latent image according to a potential gap on the photosensitive drum 144.

Thereafter, at certain timing, the sheet whose front end position is corrected is transported from the resist roller 143 to the photosensitive drum 144, and the toner on the photosensitive drum 144 is transferred to the sheet by a transfer unit. The toner left on the photosensitive drum 144 is scratched off by a cleaning blade of a drum unit, and the toner thus scratched off is collected by a cleaner unit.

The sheet to which the toner was transferred is heated and pressed by passing through a path between (i) an upper heat roller 161 of a fixing apparatus and (ii) a lower heat roller 162 thereof. With this, the toner unfixed to the sheet is fused and fixed to the sheet. Thereafter, the sheet is ejected to the eject tray in the apparatus by sheet ejecting rollers 163 and 164.

By the way, the present embodiment uses the weight 14 to cause the projecting section 15 of the sheet detecting sensor 10 to project from the sheet setting surface 2; however, instead of the weight 14, e.g., a spring member such as a spring may be used to cause the projecting section 15 to project from the sheet setting surface 2.

Further, it is preferable that the image forming apparatus 100 include a manual sheet feeding tray 30 so as to allow sheets to be manually fed thereto. As shown in FIG. 6, the manual sheet feeding tray includes: (i) detecting sensors 31, (ii) a sheet setting surface 32 on which sheets are set, and (iii) sheet guides 33. Each of the sheet detecting sensors 31 has the same structure as the structure of the aforementioned sheet detecting sensor 10 of the sheet tray 1. With this, the same effect as the effect of the sheet tray 1 is attained in the manual sheet feeding tray 30.

Note that the explanation above exemplifies the digital copying machine as the image forming apparatus; however, the image forming apparatus according to the present invention may be (i) a non-digital copying machine, (ii) an apparatus such as a printer or a FAX (facsimile), or (iii) a multifunctional apparatus having the functions of these apparatuses. In other words, the image forming apparatus according to the present invention may be any apparatus including the aforementioned sheet tray.

EMBODIMENT 2

The following explains another embodiment of the sheet tray, which is according to the present invention and which is provided in a sheet transporting apparatus or the like, with reference to FIG. 7 and FIG. 9(*b*). Note that a difference between (i) a sheet detecting sensor of the sheet tray according to the present embodiment, and (ii) the sheet detecting sensor 10 of the sheet tray 1 explained in Embodiment 1 lies in the structure in the projecting section.

The sheet detecting sensor in the sheet tray according to the present embodiment has a projecting section whose structure is different from the aforementioned projecting section 15. More specifically, as shown in FIG. 7, the projecting section 15*a* of the sheet detecting sensor 10*a* is made up of: (i) an actuator ball (ball) 15*b*, and (ii) a ball holder 15*c* for rotatably holding the actuator ball 15*b* on a supporting bar 13*a*. Moreover, as shown in FIG. 8, the actuator ball 15*b* is held by (i) a dome-shaped actuator holder 13*b* of the supporting bar 13*a*, and (ii) a dome-shaped ball holder 15*c* thereof. In other words, the actuator ball 15*b* is held in a holder constituted by combining the actuator holder 13*b* and the ball holder 15*c*.

Further, the ball holder 15*c* has a circular-shaped aperture portion 15*d*, through which a part of the actuator ball 15*b* is exposed. The aperture portion 15*d* has a diameter smaller than the diameter of the actuator ball 15*b*. This prevents the actuator ball 15*b* from being displaced from the holder.

The following explains how the sheet detecting sensor 10*a* detects a sheet, with reference to FIG. 9(*a*) and FIG. 9(*b*).

Firstly, see FIG. 9(*a*). Normally, the sheet detecting sensor 10*a* is on standby. While the sheet detecting sensor 10*a* is on standby, the sheet detecting sensor 10*a* detects that there is no sheet set on the sheet setting surface 2, and the projecting section 15*a* projects from the aperture portion (setting surface aperture portion) of the sheet setting surface 2. The light shielding rib 16 shields the incoming light to the photo sensor 12, so that the photo sensor 12 does not detect the light. The sheet detecting sensor 10*a* regards such a condition under which the photo sensor 12 detects no light, as the condition (absence of sheets) under which no sheet is set on the sheet setting surface 2.

Next, see FIG. 9(*b*) illustrating a case (sheet set state) where sheets P are set on the sheet setting surface 2. In this case, the sheets P press down the projecting section 15*a* of the sheet detecting sensor 10*a* in the direction of the sheet setting surface 2. Accordingly, the light shielding rib 16 does not shield the incoming light to the photo sensor 12, with the result that the photo sensor 12 detects the light. The sheet detecting sensor 10*a* regards such a condition under which the photo sensor 12 detects the light, as the condition (presence of sheets) under which the sheets P are set on the sheet setting surface 2.

When the sheets P are set on the sheet setting surface 2, the sheets P make contact with the actuator ball 15*b* of the projecting section 15*a* of the sheet detecting sensor 10*a* of the present embodiment. The actuator ball 15*b* rotates in response to the collision of the projecting section 15*a* with the sheets P, so that the sheets P can be prevented from being scratched by the projecting section 15*a* even when setting the sheets P on the sheet setting surface 2 from any direction and any angle. This allows prevention of (i) the breakage of the sheets P and (ii) the breakage of the projecting section 15*a*. Also, such a projecting section 15*a* allows prevention of crease on the sheets P. Moreover, such a projecting section 15*a* never scratches a part of the user's body, so that the user can be prevented from being injured. The sheets P are never scratched by the projecting section 15*a* as such, and are so set on the sheet setting surface 2 as to press down the projecting section 15*a*, so that the sheet detecting sensor 10*a* can precisely detect whether or not there are sheets on the sheet setting surface 2.

It is preferable that the circular-shaped aperture portion of the sheet setting surface 2 have a diameter smaller than the diameter of the actuator ball 15*b*. This makes it possible to further prevent the displacement of the actuator ball 15*b* from the sheet tray 1.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

As described above, a sheet tray of the present invention includes: a sheet detecting means including (i) a movable detecting section having a projecting section which projects from a sheet setting surface, and (ii) a detecting section for detecting rotation of the movable detecting section, the projecting section having a ball-like shape.

According to the structure above, the projecting section has the ball-like shape. Therefore, the sheet can be prevented from being scratched by collision with the projecting section, even when setting the sheet on the sheet setting surface from any direction and any angle. This allows prevention of (i) the breakage of the sheet, and (ii) the breakage of the projecting section. Moreover, with this, a part of the user's body is never scratched by the projecting section, so that the user can be prevented from being injured.

Further, the sheet tray of the present invention is arranged such that the detection section is so provided as to detect one end of the movable detecting section. This allows more precise detection of the rotation of the movable detecting section, even when the movement of the movable detecting section is slight.

It is preferable to arrange the sheet tray of the present invention such that: the projecting section includes a ball, which is rotatably held by a holder, and the ball is exposed from an aperture portion of the holder, and projects from the sheet setting surface. According to the structure above, the ball is rotatable, so that the sheet can be further prevented from being scratched by the projecting section that is the ball. This allows further prevention of (i) the breakage of the sheet and (ii) the breakage of the projecting section. This also allows prevention of crease on the sheet.

Further, a part of the user's body is never scratched by the projecting section that is the ball, so that the user can be further prevented from being injured. Further, it is preferable that the aperture portion of the holder have a diameter smaller than the diameter of the ball. This allows prevention of displacement of the ball from the holder.

Further, it is preferable to arrange the sheet tray of the present invention such that: the projecting section of at least one of the sheet detecting means projects from the sheet setting surface, and is positioned away, from an end regulating member for regulating an end of each sheet set on the sheet setting surface, by either (i) a distance corresponding to a smallest width of a standard sheet, or (ii) a distance shorter than the distance. This makes it possible to detect a sheet having the smallest standard size.

A sheet transporting apparatus of the present invention includes the sheet tray.

According to the structure above, the projecting section has the ball-like shape. Therefore, the sheet can be prevented from being scratched by collision with the projecting section, even when setting the sheet on the sheet setting surface from any direction and any angle. This makes it possible to provide a sheet transporting apparatus that allows prevention of (i) the breakage of the sheet, and (ii) the breakage of the projecting section. Moreover, with this, a part of the user's body is never scratched by the projecting section, so that the user can be prevented from being injured.

An image forming apparatus of the present invention includes the sheet tray.

According to the structure above, the projecting section has the ball-like shape. Therefore, the sheet can be prevented from being scratched by collision with the projecting section, even when setting the sheet on the sheet setting surface from any direction and any angle. This makes it possible to provide an image forming apparatus that allows prevention of (i) the breakage of the sheet, and (ii) the breakage of the projecting section. Moreover, with this, a part of the user's body is never scratched by the projecting section, so that the user can be prevented from being injured.

The invention claimed is:

1. A sheet tray, comprising:

at least one sheet detecting means for detecting a sheet set on a sheet setting surface, wherein:

the sheet detecting means includes (i) a movable detecting section having a projecting section which projects from the sheet setting surface, and (ii) a detecting section for detecting rotation of the movable detecting section;

the projecting section includes a ball, which is rotatably held to the movable detection section by a dome-shaped ball holder fixed to said movable detection section; and the ball is exposed from an aperture portion of the holder, and projects from the sheet setting surface.

2. The sheet tray as set forth in claim 1, wherein:

the detecting section is so provided as to detect an end of the movable detecting section.

3. The sheet tray as set forth in claim 1, wherein:

the aperture portion of the holder has a diameter smaller than a diameter of the ball.

4. The sheet tray as set forth in claim 1, wherein:

the projecting section of at least one of the sheet detecting means projects from the sheet setting surface, and is positioned away, from an end regulating member for regulating an end of each sheet set on the sheet setting surface, by either (i) a distance corresponding to a smallest width of a standard sheet, or (ii) a distance shorter than the distance.

5. The sheet tray as set forth in claim 1, wherein:

the detecting section is a photo sensor.

6. The sheet tray as set forth in claim 1, wherein:

said sheet tray is a manual sheet tray.

7. A sheet transporting apparatus, comprising:

said sheet tray as set forth in claim 1.

8. The sheet transporting apparatus as set forth in claim 7, wherein:

said sheet transporting apparatus is an automatic document transporting apparatus.

9. An image forming apparatus, comprising:

said sheet tray as set forth in claim 1.

10. The image forming apparatus as set forth in claim 9, wherein:

said image forming apparatus is a copying machine.

11. The image forming apparatus as set forth in claim 9, wherein:

said image forming apparatus is a printer.

12. The image forming apparatus as set forth in claim 9, wherein:

said image forming apparatus is a facsimile.

13. The sheet tray as set forth in claim 2, wherein:

the projecting section of at least one of the sheet detecting means projects from the sheet setting surface, and is positioned away, from an end regulating member for regulating an end of each sheet set on the sheet setting surface, by either (i) a distance corresponding to a smallest width of a standard sheet, or (ii) a distance shorter than the distance.

14. The sheet tray as set forth in claim 3, wherein:

the projecting section of at least one of the sheet detecting means projects from the sheet setting surface, and is positioned away, from an end regulating member for regulating an end of each sheet set on the sheet setting surface, by either (i) a distance corresponding to a smallest width of a standard sheet, or (ii) a distance shorter than the distance.

15. The sheet tray as set forth in claim 2, wherein:

the detecting section is a photo sensor.

16. The sheet tray as set forth in claim 3, wherein:

the detecting section is a photo sensor.

17. The sheet tray as set forth in claim 4, wherein:

the detecting section is a photo sensor.

18. The sheet tray as set forth in claim 2, wherein:

said sheet tray is a manual sheet tray.

19. The sheet tray as set forth in claim 3, wherein:

said sheet tray is a manual sheet tray.

20. The sheet tray as set forth in claim 4, wherein:

said sheet tray is a manual sheet tray.

* * * * *